United States Patent [19]

Rao et al.

[11] Patent Number: 4,952,345

[45] Date of Patent: Aug. 28, 1990

[54] METHOD FOR CONTROLLING POLYMER VISCOSITY

[75] Inventors: Sundar M. Rao; Richard P. Dale; Laura A. Murphy, all of Seaford, Del.

[73] Assignee: E. I. du Pont de Nemours and Company, Wilmington, Del.

[21] Appl. No.: 308,773

[22] Filed: Feb. 10, 1989

[51] Int. Cl.[5] ..... D01F 6/60; D01D 1/04

[52] U.S. Cl. ..... 264/40.6; 264/40.1; 264/211; 264/349

[58] Field of Search ..... 264/40.1, 40.6, 211, 264/349; 137/92, 2; 73/160

[56] References Cited

U.S. PATENT DOCUMENTS

| | | | |
|---|---|---|---|
| 2,571,975 | 10/1951 | Waltz | 264/211 |
| 2,943,350 | 7/1960 | Rodenacker | 264/211.14 |
| 4,591,468 | 5/1986 | Follows et al. | 264/40.1 |
| 4,721,448 | 1/1988 | Irish et al. | 264/40.6 |
| 4,721,589 | 1/1988 | Harris | 264/40.6 |

*Primary Examiner*—Hubert C. Lorin

*Attorney, Agent, or Firm*—Bernard, Rothwell & Brown

[57] ABSTRACT

Uniformity of properties of spun polyamide filaments is improved by treating flake polyamide with successive nitrogen gas streams, the first having a variable temperature and water content, and the second being dry but having a variable flow rate. Viscosity of the molten polyamide from a melter for the flake is determined by measuring differential pressure across a transfer pipe. The viscosity measurement is used by automatic control apparatus to control the flow rate of the second stream, and the moisture content of a make-up stream added to the first stream. The flow rate of the make-up stream is controlled to maintain the second stream within limits, and the temperature of the first stream is controlled to maintain the flow rates of the make-up and second streams within limits.

9 Claims, 7 Drawing Sheets

METHOD FOR CONTROLLING POLYMER VISCOSITY

BACKGROUND OF THE INVENTION

1. Technical Field

The present invention relates to the control of the viscosity of a molten polymer which is subject to a depolymerization-polymerization equilibrium reaction influenced by the moisture content of the melt. Such control particularly finds use in polyamide spinning apparatus and processes.

2. Description of the Prior Art

Polyamides heated to temperatures required for melt spinning are subject to depolymerization. The degree of depolymerization or the equilibrium point of depolymerization-polymerization is a function of the amount of water present in the melt. Nylon flake, or other solid raw nylon material used for melt spinning, contains varying amounts of moisture depending upon its preparation and storage history. For example, the absorbed moisture in the solid nylon material is dependent upon the amount of atmospheric humidity to which the nylon has been exposed. Varying molecular weight of the molten polymer resulting from depolymerization of the nylon produces undesirable variation in the tenacity, elongation and dye properties of the spun filaments.

The prior art, as exemplified in U.S. Pat. Nos. 2,571,975 and 2,943,350, discloses passing the nylon, in molten or flake form, through a chamber where the nylon is exposed to steam or a controlled atmosphere having a constant and predetermined water vapor content to reduce moisture variations in the polymer and provide more uniform properties in the spun filaments. Steam generally results in excessive depolymerization of the molten polymer, and exposing flake polymer to an atmosphere of fixed humidity for a short period is generally deficient in providing uniformity of moisture content, particularly in center portions of the solid flakes. Water content of the polymer flake can vary from the core to the surface of each flake.

A prior art spinning apparatus with an automatic control system for controlling relative viscosity of the polymer being spun, as illustrated in FIGS. 1–4, includes a conditioner indicated generally at 20 for conditioning polyamide flake 22 which is then melted in a screw melter 24 and fed through a transfer line 26 to a manifold 28. Metering pumps 29 feed the polymer from the manifold 28 to a plurality of spinnerettes 30 each producing a plurality of filaments 32 which are cooled in air. Automatic digital control apparatus, indicated generally at 40, controls the conditioner 20 to adjust the moisture content of the polyamide flake in response to detected changes in relative viscosity of the molten polymer to maintain relative viscosity of the molten polymer within a narrow range. Relative viscosity is calculated from differential pressure, temperature and throughput measurements of the molten polymer in the transfer line 26 by measuring facilities indicated generally at 42 to enable rapid on-line determination and control of polymer relative viscosity. Maintaining a predetermined relative viscosity produces substantially uniformity in the tenacity, elongation and dye properties of the spun filaments 32.

Polymer flake moisture content is adjusted in the conditioner 20 by passing the flake through an upper zone or chamber 44 where the flake is exposed to a circulating inert gas flow 46, and then through a lower zone or chamber 48 where the flake is exposed to a transition inert gas flow 50. The circulating gas flow 46 is selectively adjusted in both its temperature and humidity, the humidity being adjusted in turn by adjusting the flow rate of a make-up gas flow 52 added to the circulating gas flow 46. In this prior art system, the moisture content of the make-up gas flow 52 is maintained at a predetermined value. The dry transition gas 50 is selectively adjusted in flow rate.

Generally, the moisture content of the polymer flake entering the conditioner 20 is greater than that moisture content which produces the desired relative viscosity in the molten polymer, and thus a portion of the moisture absorbed in the polymer is removed by the circulating gas 46 and the transition gas 50 to achieve the desired relative viscosity in the molten polymer. Adjustments of the flow rate of the transition gas 50 in response to detected changes in the relative viscosity of the molten polymer provide primary control of the relative viscosity of the molten polymer. Secondary control is provided by adjustment of the make-up gas flow rate to maintain the transition gas flow rate within an effective operable range. Adjustment of the circulating gas temperature, which has the slowest effect on polymer viscosity of the three adjustments, maintains the transition gas flow rate and the make-up gas flow rate within respective ranges.

Polymer flake 22 is fed by pneumatic feeding mechanism 56 to the upper chamber 44 of the conditioner 20. A circulating gas inlet 58 communicates with the bottom of the chamber 44 and a circulating gas outlet 60 communicates with the top of the chamber 44 for directing the circulating gas flow through the bed of polymer flake in the chamber 44. The inlet of a blower 62 is connected to the outlet 60 while the outlet of the blower 62 is connected through a heater 64 to the inlet 58 to provide the continuous circulating gas flow. The heater 64 is an indirect heat exchanger which heats the circulating gas 46 indirectly by a steam flow which is controlled by a valve 66.

The make-up gas stream 52, which is normally lower in water vapor content by weight percent than the circulating gas stream 46, is added to the circulating gas stream at point 68 upstream from the blower 62 to provide for adjustment of the humidity of the circulating gas stream 46 as well as to provide replacement gas for humid gas outflow through vent 67 and any gas loss through the flake feeding system. Valve 69 in the vent stream 67 is controlled to maintain a predetermined pressure slightly above atmosphere in the chamber 44 and the circulating gas loop 46. Cyclone 71 removes fines from the vent stream for recycle, disposal or other use. The flow rate of the make-up gas from a dry nitrogen source 70 is controlled by a valve 72. The nitrogen stream 52 is passed through a humidifier vessel 74 where the gas is subjected to a water bath heated to a predetermined temperature by resistance heater 76 to add the desired water vapor to the gas. Adjustment of the electric current through the heater 76 maintains a predetermined water temperature in the humidifier 74 to maintain the predetermined water vapor content of the make-up stream 52.

The flow rate of the transition gas stream 50 from the dry nitrogen source 70 is controlled by a valve 80.

The screw melter 24 includes its own conventional heating source (not shown) and temperature control (not shown) for melting the polymer flake. The temperature of the molten polymer exiting from the melter 24 is controlled by the controls of the screw melter 24 with a high degree of accuracy.

In the automatic control 40, a supervisory computer 90 with a manual input device or keyboard 92 is connected by respective two-way data communication lines 94 to a controller 100 for reading sensor values, set points, and other data from the "highway" of the controller and for transmitting set points to the controller. The controller 100 includes conventional distributed control units with inputs connected to various sensors and with outputs connected to various device drivers in the spinning apparatus to monitor operation and to provide automatic control for the spinning operation. Only those operations and apparatus utilized in the automatic control of relative viscosity of the molten polymer are disclosed herein.

Inputs of the control units in the controller 100 are connected to a gas flow rate sensor 110 in the transition gas flow line 50, to a water temperature sensor 112 in the humidifier vessel 74, to a gas flow rate sensor 114 in the make-up gas flow line 52, to a gas temperature sensor 116 in the circulating gas line 46 at the inlet 58, to a pressure sensor 118 in the vent line 67, to a polymer pressure sensor 120 at the beginning of the transfer line 26, to a polymer pressure sensor 122 in the manifold 28, to a polymer temperature sensor 124 in the manifold 28, and to sensors detecting operation and flow rates of metering pumps 29 for monitoring the respective flow rates, pressures and temperatures. The control units of the controller 100 have outputs connected to a valve operating device 130 for the valve 80, to an electric current control device (not shown) controlling current to the resistance heater 76, to a valve operating device 134 for the valve 72, to a valve operating device 136 for the valve 66, and to a valve operating device 138 for the valve 69 for controlling the respective gas flows and temperatures in accordance with set points in the controller 100.

The set points in the controller 100 can be set by internal calculations or manual input (not shown) to the controller, or can be set by signals sent from the supervisory computer 90. In this prior art system, three set points in the controller 100 are updated every 60 seconds by signals sent from the supervisory computer 90 in connection with control of polymer relative viscosity. These three set points which are controlled continuously, i.e. updated once every minute, by the supervisory computer are (1) the humidifier gas flow rate set point for control of humidifier flow rate valve 72 based upon the flow rate sensed by sensor 114, (2) the circulating gas temperature set point for control of valve 66 based upon the temperature sensed by sensor 116, and (3) a compensated differential pressure set point which is used by the controller 100 to calculate a transition gas flow rate set point for control of the transition gas flow rate valve 80 based upon the flow rate sensed by the sensor 110. The set points for control of the electrical current through the heater 76 based upon the temperature reading from sensor 112 and for control of the vent valve 69 based upon the pressure reading from sensor 118 are not updated and can only be changed during normal operation by manual operator input. The controller 100 operates at a cycle rate of about 2 hertz; thus the controller performs its calculations and updates the signals to the device drivers about once every 0.5 seconds.

Overall supervisory control of the process is provided by the supervisory computer 90 which operates in accordance with the program set forth in FIGS. 3A, 3B and 3C. Initial operator inputs of target relative viscosity and target transition gas flow are inputted by steps 150 and 152, FIG. 2, of an interrupt procedure, an operator input procedure which is only called during the first operating run, or the like. In step 160 of FIG. 3A, the computer 90 reads data from the controller "highway". These readings include the current polymer pressures from sensors 120 and 122, the current compensated differential pressure which has been calculated by the controller 100, the current transition gas flow rate from the sensor 110, the current make-up gas flow rate from sensor 114, the current polymer throughput rate from the metering pumps 29, and the current molten polymer temperature from the sensor 124. Then is step 162 the relative viscosity of the molten polymer is calculated from the current values of polymer pressure, temperature and throughput in accordance with the FORTRAN equation:

$$RV=[(C_2*T-C_3)*(melt\ viscosity)**C_4]+C_5 \quad (1)$$

where:

*melt viscosity*$=(P_1-P_2)/(throughput*C_1)$ $P_1$=the measurement from pressure sensor 120

$P_2$=the measurement from pressure sensor 122

T=the polymer temperature from sensor 124 throughput=throughput percent from meter pumps 29

$C_1$=0.0001 to 0.0003 (dependent upon piping geometry)

$C_2$=0.882

$C_3$=332

$C_4$=0.3818

$C_5$=0.0 to 3.0 (dependent upon the degree of unfinished polymerization in the piping)

Equation (1) compensates the differential pressure measurement with respect to variations in polymer temperature, and normalizes or compensates the differential pressure measurement with respect to throughput percentage so that the result reflects relative viscosity of molten polymer.

Referring to FIG. 3B, a new make-up gas flow set point is computed in step 178 using a conventional "three mode" proportional-integral-differential (P−I−D) algorithm with the target transition gas flow rate from step 152, the current transition gas flow rate from step 160 and the current make-up gas flow rate from step 160 as arguments. In step 180, the new make-up gas flow set point is sent to the controller 100. An increase in the make-up gas flow rate results in a higher rate of exhaust flow of the moist circulating gas through the vent 67 to decrease the moisture content to the circulating gas and the polymer flake which in turn decreases depolymerization and increases viscosity of the molten polymer. Conversely, a decrease in the make-up gas flow rate allows the moisture content of the circulating gas to increase resulting in greater depolymerization and lower viscosity of the molten polymer. Thus the make-up gas flow set point is adjusted to maintain the transition gas flow rate near to the target transition gas flow rate.

The following steps 182, 184, 186, 188 and 190 determine a circulating gas bias used to maintain the transition gas flow rate and the make-up gas flow rate within predetermined upper and lower limits. In step 182, a transition gas flow less than the lower limit of the transition gas flow and a make-up gas flow less than the lower limit of the make-up gas flow results in a branch to step 184 where a circulating gas bias is set to a negative value. If step 182 is false, then the program proceeds to step 186 where a transition gas flow greater than the high limit for the transition gas flow and a make-up gas flow greater than the high limit for the make-up gas flow results in a branch to step 188 where the circulating gas bias is set to a positive value. If step 186 is false, then the program proceeds to step 190 where the circulating gas bias is set to zero.

In step 192 of FIG. 3C, the bias set in step 184, 188 or 190 of FIG. 3B is added to the current circulating gas temperature set point to produce a new circulating gas temperature set point. In step 198, the new circulating gas temperature set point from step 190 is sent to the controller 100. Reducing the circulating gas temperature allows more moisture to remain in the polymer flake in the chamber 44 causing the transition gas flow to increase which in turn can result in an increase in the make-up gas flow to maintain the transition and make-up gas flow rates below respective limits. Increase of the circulating gas temperature decreases flake moisture content which increases polymer relative viscosity and results in reduction of transition gas flow which in turn can produce a decrease in make-up gas flow to maintain the transition and make-up gas flows above respective lower limits.

Steps 202 and 204 in the supervisory computer provide a new compensated differential pressure set point for the controller 100 which uses this compensated differential pressure set point to provide primary control of the transition gas flow. In step 202, the target relative viscosity from step 150, the calculated relative viscosity from step 162, and the current compensated differential pressure from step 160, are applied to a P−I−D algorithm to compute the new compensated differential pressure set point. This new compensated differential pressure set point is sent to controller 100 in step 204.

The operation or programming of the controller 100 is illustrated in FIG. 4. In step 210, the controller reads the various sensors such as sensors 29, 110, 114, 116, 118, 120, 122, and 124 of FIG. 1, to obtain the current flow rates, temperatures, and pressures monitored by these sensors. In step 216, any new set points such as the make-up gas flow set point from step 180, the circulation gas temperature set point of step 198, and the compensated differential pressure set point from step 204 from the supervisory computer 90 are read. In step 218, the current compensated differential pressure is calculated in accordance with the equation:

$$\text{delta-}P_{com} = \frac{10(P_1 - P_2)*[(0.1*Y) + (2.85)(1 - 0.035*M)]}{(0.286*\text{throughput})} \quad (2)$$

where

Y is the measured or current polymer temperature 124,

M is the target polymer temperature, e.g. 290° C.,

Y and M are expressed as a fraction or percentage of the range 250° to 350° C. for the purpose of input format to the controller algorithm, $P_1$ is the pressure sensed by sensor 120, $P_2$ is the pressure sensed by sensor 122, and throughput is the fraction or percentage of total spinning positions or metering pumps 29 in operation.

In step 224, the controller 100 computes a new transition gas flow rate set point using a P−I−D algorithm with the calculated compensated differential pressure from step 218, the compensated differential pressure set point from steps 204 and 216, and the current transition gas flow rate from the step 210 as arguments.

In the steps 228, 230, 232, 234, 236, 238 and 240, the distributed control units in the controller 100 generally operate concurrently to adjust the driver signals controlling the valves 66, 69, 72, and 80, and the electric current through heater 76. In step 228, it is determined if the current transition gas flow reading from step 210 is within a set tolerance range of the new set point calculated in step 224. If false, the program proceeds to step 230 where signals are sent to the valve control device 130 to adjust the valve 80 to produce a corrected transition gas flow rate; such signals providing for incremental adjustment to avoid overshoot of the desired gas flow. In step 232 the corresponding control unit determines if the current make-up gas flow rate reading from the sensor 114 is within a set tolerance range of the set point, and if false proceeds to step 234 where signals are sent to the valve control device 124 to adjust the valve 72 and the make-up gas flow. Incremental or timed adjustment periods provide delay to avoid overshoot of the make-up gas flow. In step 236 the corresponding control unit incrementally adjusts the current flow through the resistance heater 76 if there is a difference between the reading of the temperature sensor 114 and the manually entered set point for the humidifier water temperature. In step 238 the corresponding control unit incrementally adjusts the valve 66 in accordance with any difference between the temperature of the circulating gas as sensed by sensor 116 and the circulating gas temperature set point to adjust the steam flow rate through the heater 64 to increase or decrease the circulating gas temperature. In step 240, the corresponding control unit incrementally adjusts the vent valve 69 in accordance with any difference between the pressure sensed by sensor 118 and the manually entered circulating gas pressure set point.

In step 242, the controller 100 sends sensor readings and calculated values to the controller "highway" for being available to be read by the supervisory computer 90. The controller 100 can then begin a new cycle of operation.

The prior art system of FIGS. 1–4 provides acceptable control of polymer relative viscosity for single screw extrusion apparatus, but when the system was applied to a double screw extrusion apparatus, the system was found to produce increased fluctuations in the relative viscosity of the molten polymer. This causes excessive variations in tenacity, elongation and dye properties of the spun filaments.

SUMMARY OF THE INVENTION

The present invention is summarized in a process and apparatus for spinning a synthetic linear polyamide wherein concurrent adjustments of humidifier water temperature and transition gas flow are utilized to provide primary control of relative viscosity of molten polyamide. The primary control or the adjustments of humidifier water temperature and transition gas flow are based upon a difference between a predetermined relative viscosity and a measured relative viscosity of the molten polyamide being spun.

In one embodiment, polyamide flake is passed successively through first and second treatment chambers and then melted. The relative viscosity of the molten polyamide is determined before extruding the molten polyamide through spinning heads to form filaments. A first treatment gas is passed through the first treatment chamber. The first treatment gas is varied in humidity by adjustment of the flow rate and the moisture content of a make-up gas flow and by adjustment of the temperature of the first treatment gas. A second treatment gas which is dry is passed through the second treatment chamber. The moisture content of the make-up gas flow and the flow rate of the second treatment gas are adjusted proportionally and inversely, respectively, in accordance with the measured relative viscosity of the molten polyamide to maintain a desired relative viscosity.

An object of the invention is to provide a method and apparatus for spinning a synthetic linear polyamide to produce filaments which have substantially improved uniformity in tenacity, elongation and dye properties.

One advantage of the invention is the utilization of adjustment of moisture content of make-up gas flow concurrently with adjustment of transition gas flow rate in response to variation of measured relative viscosity from a target relative viscosity to provide improved uniformity of polymer properties.

A feature of the invention is the concurrent primary control of relative viscosity by adjustment of both transition gas flow and make-up gas water content along with secondary control by adjustment of make-up gas flow and tertiary control by adjustment of circulating gas. The secondary control or adjustment of the make-up gas flow is based upon a difference between a predetermined transition gas flow and a measured transition gas flow. Tertiary control or adjustment of the circulating gas temperature is based upon make-up gas flow and transition gas flow being outside of desirable ranges.

Other objects, advantages, and features of the invention will be apparent from the following description of the preferred embodiment and the accompanying drawings.

DESCRIPTION OF THE PREFERRED EMBODIMENT

Figure 5:
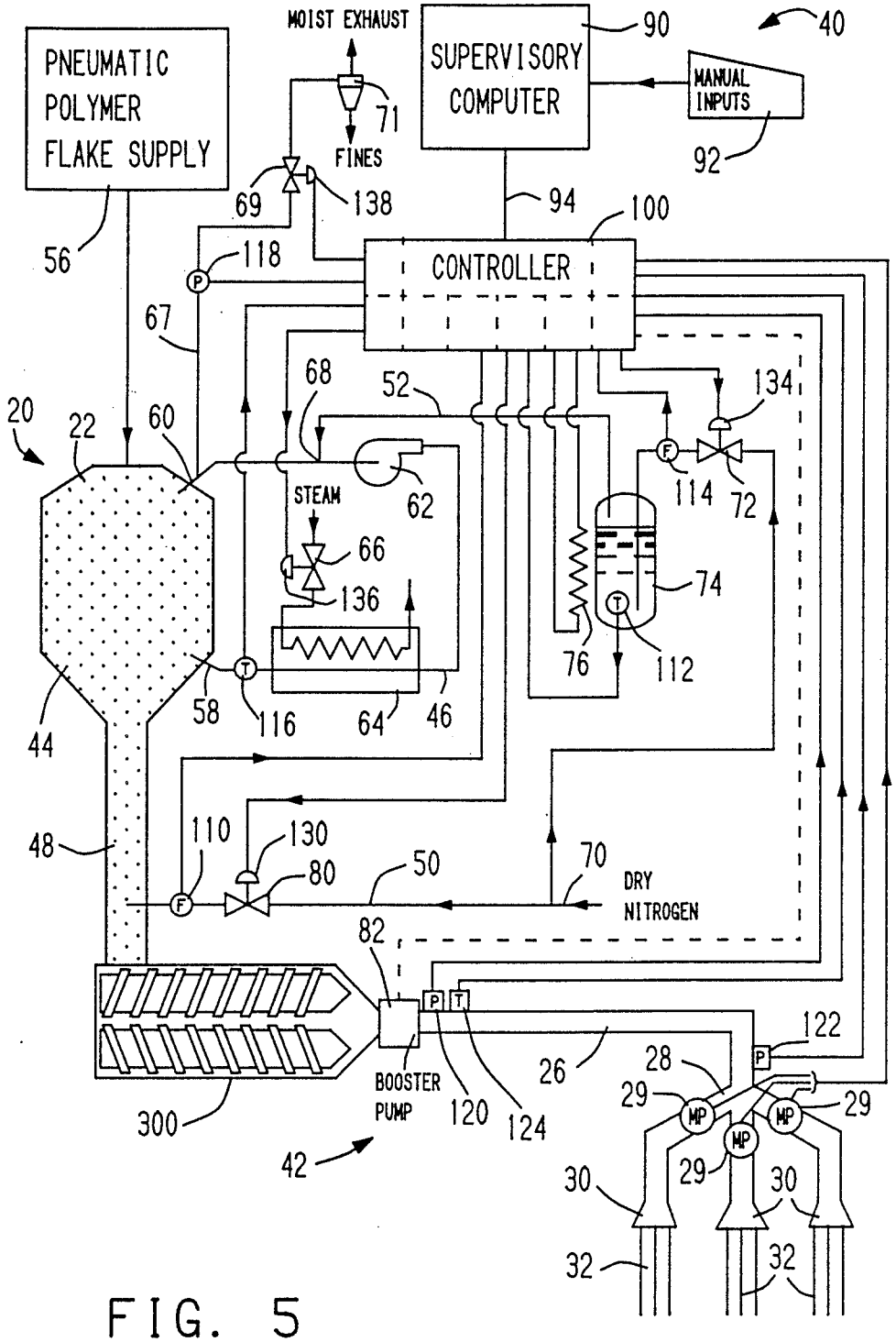
FIG. 5 is a diagrammatic view of an apparatus and process for spinning polyamide filaments in accordance with the present invention.
Figure 6:
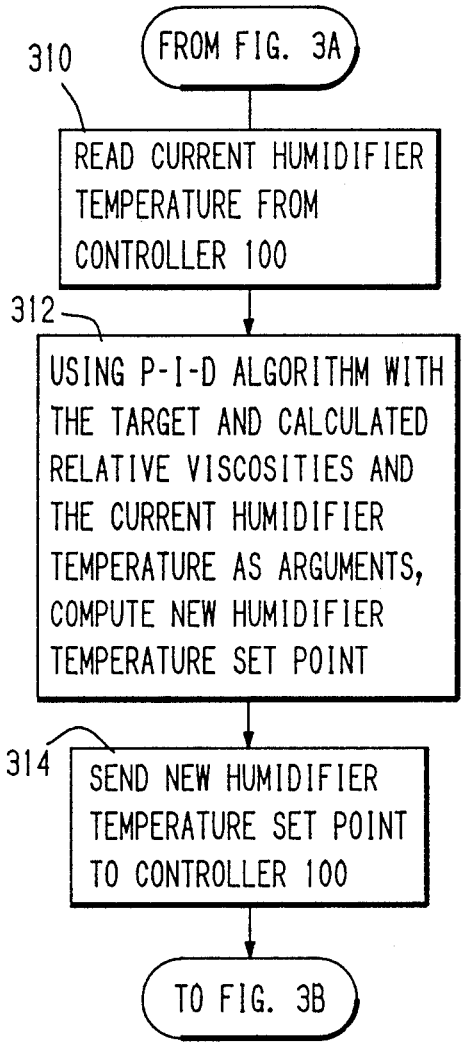
FIG. 6 is a program flow chart of additional program steps which are used along with the steps in FIGS. 3A, 3B and 3C to form a control program for the supervisory computer in the apparatus and process of FIG. 5.
Figure 7:
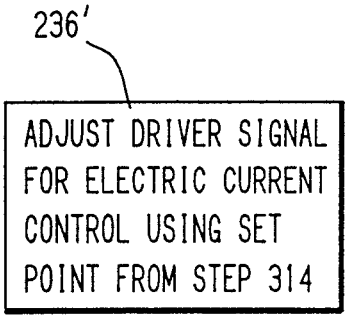
FIG. 7 is a modified program step which is substituted for one step in FIG. 4 to form a program for operating a controller in FIG. 5.

As illustrated in FIGS. 5, 6 and 7, an apparatus and process in accordance with the invention for spinning polyamide filaments using a twin screw extruder 300 includes steps 310, 312 and 314 in the control program for the supervisory computer 90 and includes a modified step 236' in the program for the controller 100 for varying the moisture content of the make-up gas flow 52 in accordance with variation of the determined relative viscosity of the molten polyamide from a selected relative viscosity. This primary humidity control is concurrent with the variation of the rate of transition gas flow 50. Thus the apparatus and process of FIGS. 5, 6 and 7 have concurrent primary control of polymer relative viscosity by variation of both the transition gas flow rate and the water content of the make-up gas. This dual primary control is found to substantially reduce variations in relative viscosity of molten polymer from the twin screw extruder compared to use of a single primary control by varying only transition gas flow in the twin screw apparatus and process.

Figure 1:
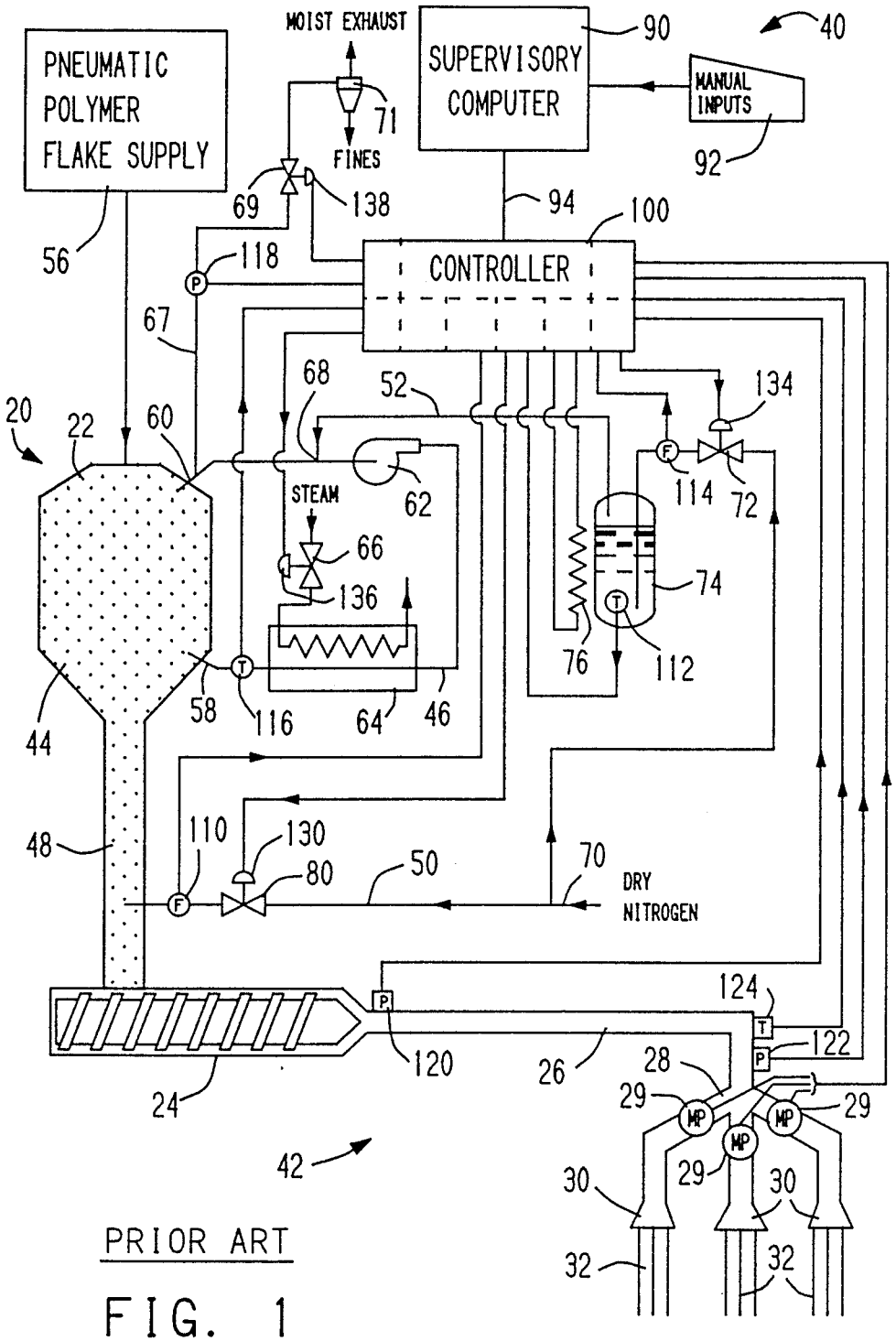
PRIOR ART FIG. 1
FIG. 1 is a diagrammatic view of a prior art apparatus and process for spinning polyamide filaments.
Figure 2:
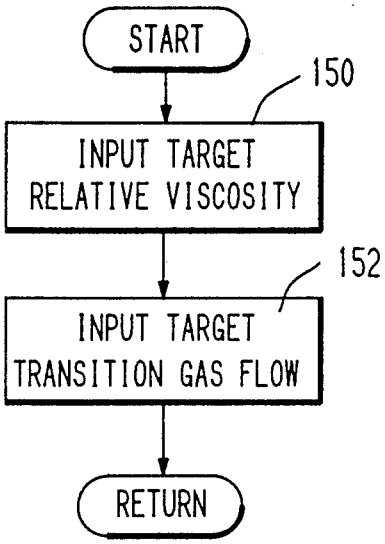
PRIOR ART FIG. 2
FIG. 2 is a program flow chart of a parameter entry procedure in a prior art program in a supervisory computer of FIG. 1.

The apparatus shown in FIG. 5 uses the same reference numerals used in FIG. 1 to identify parts which have similar structure and function. A booster pump 82 is added to connect the output of the screw melter 300 to the transfer line 26. The location of the molten polymer temperature sensor 124 is moved from the manifold 28 to the transfer line 26. Additionally, a dashed line shows the optional connection of the booster pump 82 to the controller 100 to use a speed measurement of the pump 82 as the throughput rate in an alternative to the prior art measurement of throughput rate by the sensors on the metering pumps 29.

Figure 3A:
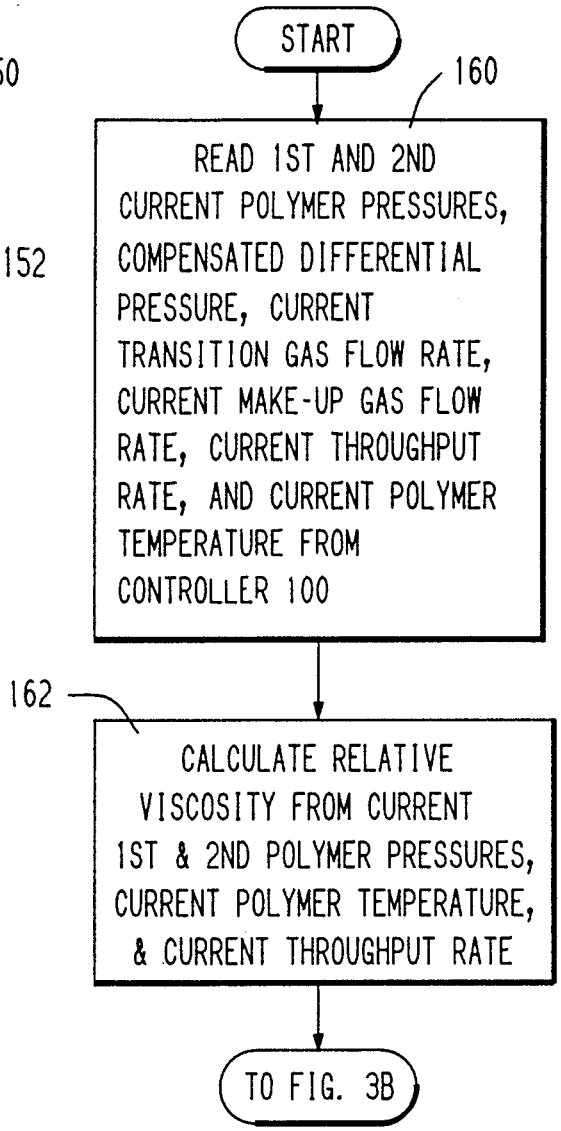
PRIOR ART FIG. 3A
FIG. 3A is a program flow chart of a first portion of a prior art control program in the supervisory computer for overall control of the apparatus and process of FIG. 1.
Figure 3B:
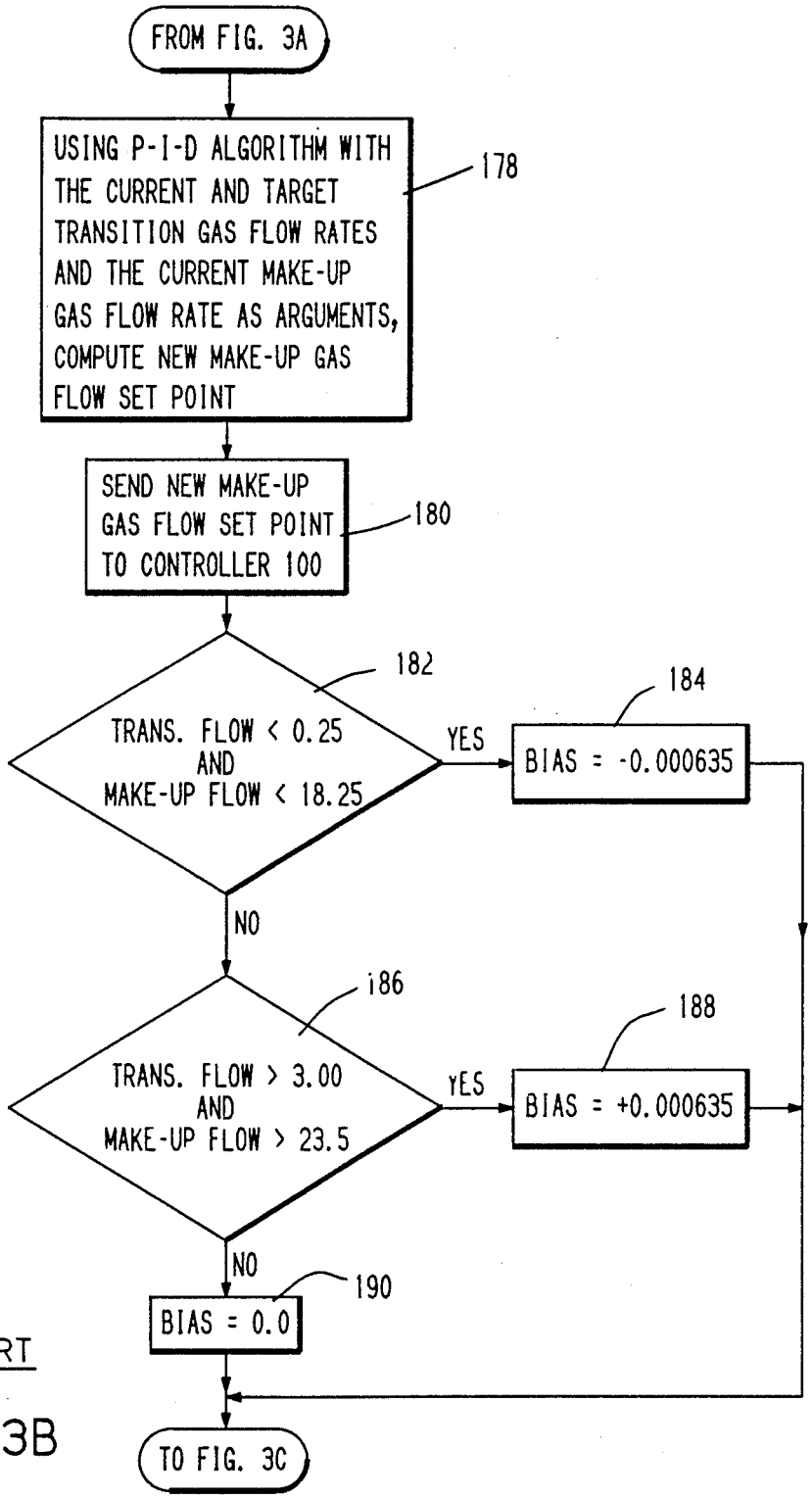
PRIOR ART FIG. 3B
FIG. 3B is a program flow chart of a second portion of the prior art control program in the supervisory computer for overall control of the apparatus and process of FIG. 1.
Figure 3C:
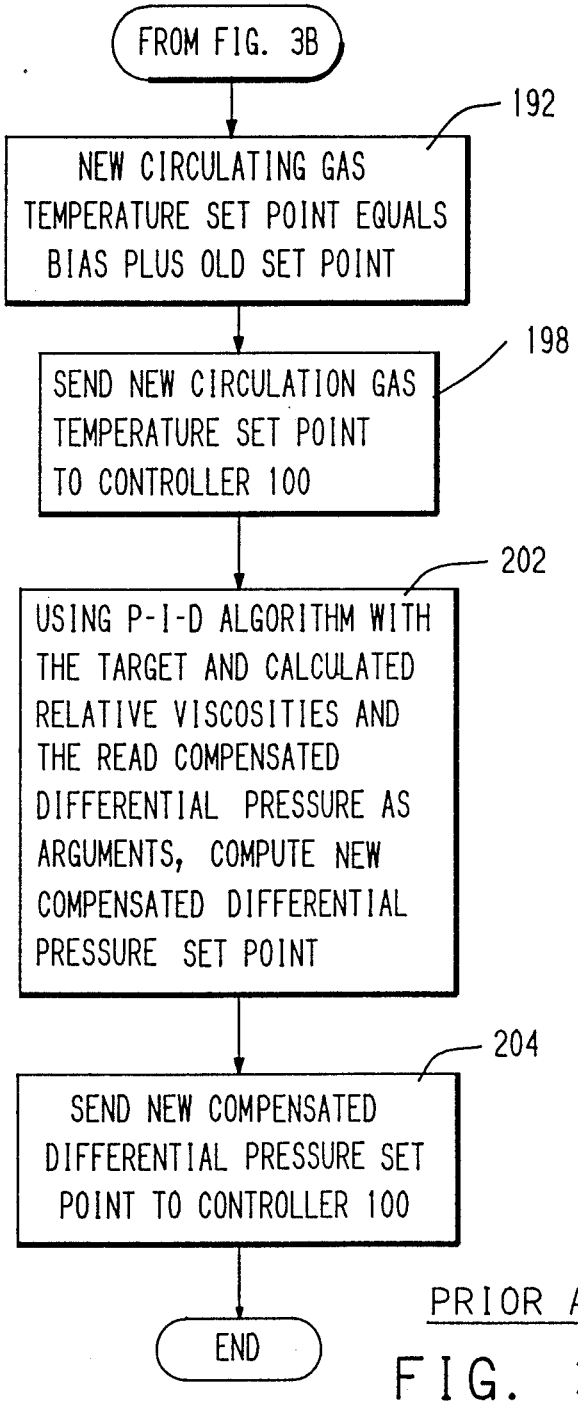
PRIOR ART FIG. 3C
FIG. 3C is a program flow chart of a third portion of the prior art control program in the supervisory computer for overall control of the apparatus and process of FIG. 1.

The steps 310, 312 and 314 of FIG. 6 are added to the program of FIGS. 3A, 3B and 3C to form the control program in the supervisory computer 90 of FIG. 5. In step 310, the supervisory computer 90 reads the current humidifier water temperature from the controller 100. This step 310 can be included by modification of the step 160 of FIG. 3A and reading of the data on the controller "highway". In the next step 312, the computer 90 calculates a new humidifier temperature set point using a conventional proportional—integral—differential (P—I—D) algorithm with the target relative viscosity from step 150, the calculated relative viscosity from step 162 and the current humidifier temperature from step 310 as arguments or inputs to the algorithm. Then this new humidifier temperature set point is sent to the controller 100 in step 314.

Figure 4:
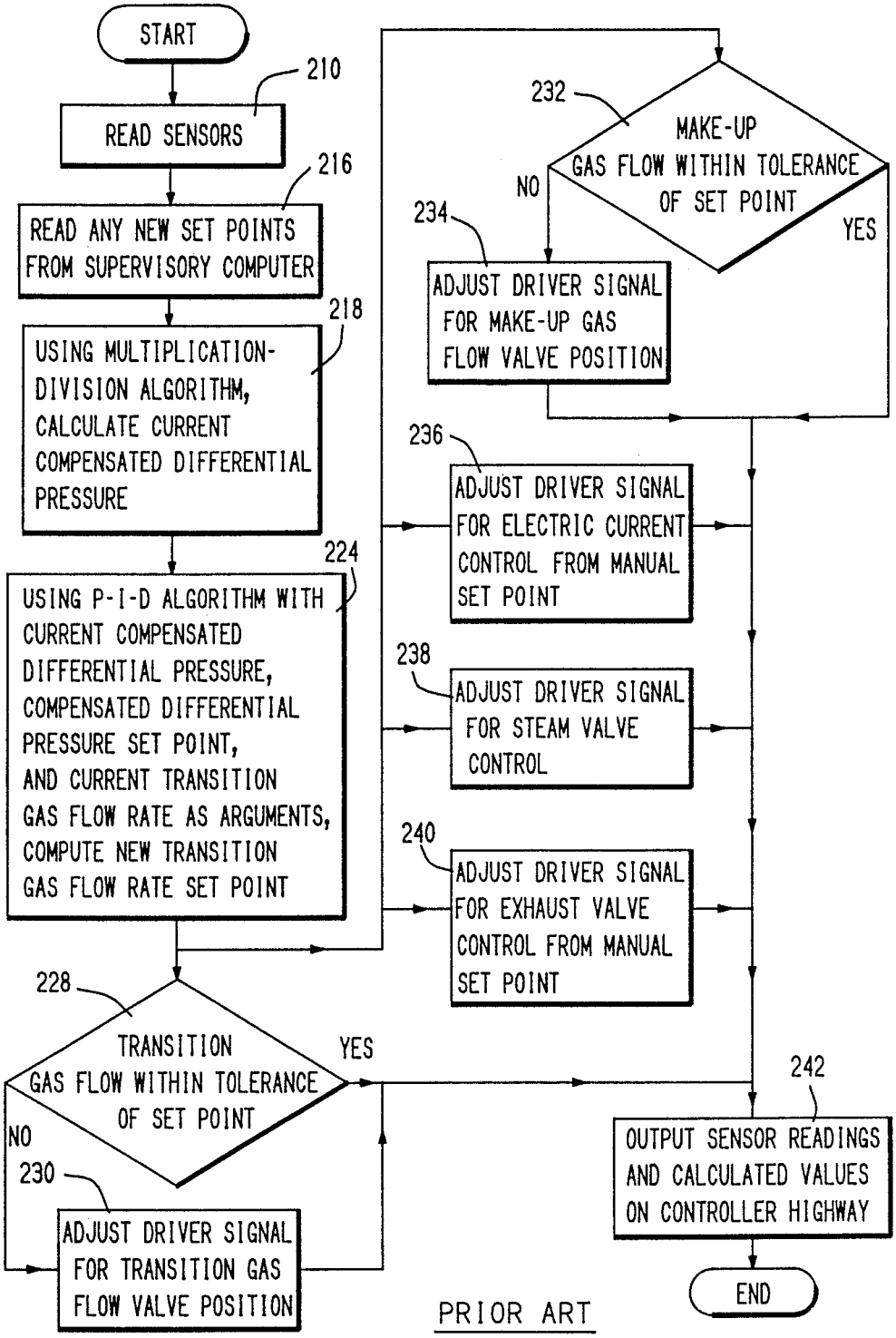
PRIOR ART FIG. 4
FIG. 4 is a program flow chart of a prior art program for operating a controller of FIG. 1.

In the controller program for the controller 100 of FIG. 5, step 236' of FIG. 7 replaces step 236 of FIG. 4. The controller 100 in step 216 of FIG. 4 reads the humidifier temperature set point from the supervisory computer 90 and then uses this set point in modified step 236' of FIG. 7 to adjust the electric current flow through the heater 76 to change the humidifier temperature. Since the set point for the humidifier temperature is changed in step 312 in accordance with changes in the calculated relative viscosity, the humidifier temperature is changed in accordance with changes in the calculated relative viscosity. When the calculated or measured relative viscosity increases, the humidifier temperature is increased to produce increased moisture content and increased depolymerization of the polyamide to reduce the relative viscosity of the molten polymer. Conversely, the humidifier temperature is decreased when the measured relative viscosity decreases to produce a corresponding decrease in flake moisture content which results in an increase in the relative viscosity.

When adjustment of the humidifier temperature, or make-up gas water content, is used as a primary control concurrent with the adjustment of the transition gas flow rate as a primary control, it is found that control of relative viscosity is substantially improved. Such improvement in uniformity of relative viscosity is believed not to be limited to the twin screw spinning apparatus but is applicable to other spinning processes such as the single screw spinning processes.

It has been determined empirically that changes in the transition gas flow have the most rapid effect on the polymer relative viscosity of the four control parameters. For example, time constants of each control parameter, acting alone, to change the current relative viscosity to a value of $(1-e^{-1})$ of the current relative viscosity were ten minutes for the transition gas flow rate; forty-five minutes for the make-up gas flow rate; sixty minutes for the humidifier temperature; and one hundred twenty minutes for the circulating gas temperature.

EXAMPLE

In an example, an apparatus in accordance with FIG. 5 employed control components as set forth in Table I, and programs as shown in FIGS. 2, 3A, 3B, 3C, 4 and 5. The P−I−D algorithm described in Chapter I, sec. 1.2 of *Instrument Engineers' Handbook (Process Control)*, edited by B. G. Liptak, published by Chilton Book Co. of Radnor, Pa., was used in steps 178, 202 and 312 in the program in the supervisory computer 90. Equation (2) of step 218 was programmed in controller 100 using Honeywell extended controller algorithm 24, multiplication/division, Honeywell Reference Manual 25-220. The P−I−D algorithm employed in step 224 was Honeywell algorithm 01, Honeywell Reference Manual 25-220.

TABLE I

| NAME | NUMBER | COMMERCIAL IDENTIFICATION |
|---|---|---|
| Supervisory Computer | 90 | DEC VAX 8200 Digital Equip. Corp., Maynard, MA |
| Local controllers for transition gas flow, humidifier temperature, make-up gas flow, circulating gas temperature, and relative viscosity measurements. | 100, 102, 104, 106, and 108 | Honeywell TDC/2000 Honeywell Inc., Industrial Controls Division |
| Gas Flowmeters | 110, 114 | Honeywell ST3000 Smart Transmitter |
| Polymer pressure sensor bulbs | 132, 134 | Honeywell ST3000 Smart Transmitter |
| Screw Melt Extruder | 24 | Werner & Pfleiderer ZSK120 extruder |

TABLE I-continued

| NAME | NUMBER | COMMERCIAL IDENTIFICATION |
|---|---|---|
| Polymer Temperature Sensor and Transmitter | 58 | Thermoelectric type JJ; Moore Industries Model 433774 |

Nylon 6,6 polymer flake having a typical absorbed moisture content of 0.2% was admitted to the flake conditioner 20 illustrated in FIG. 5. A target relative viscosity in the range 53 to 72, and a target transition gas flow rate, selected in the range below, were manually input to the supervisory computer 90. Polymer temperature was controlled in the range 280°–290° C. and throughput is 1700–2000 pounds (770–910 Kgm) per hour with all filament spinning positions operating. The setpoints for each of the four controllers are maintained within the ranges listed below.

Transition Gas Flow Rate—0–6 $ft^3$/min (0–0.17 $m^3$/min.)

Make-up Gas Flow Rate—15–45 $ft^3$/min (0.4–1.3 $m^3$/min.)

Humidifier Temperature—30°–45° C.

Circulating Gas Temperature—155°–190° C.

Since many modifications, variations and changes in detail may be made to the above described embodiment without departing from the scope and spirit of the invention, it is intended that the above description and the accompanying drawings be interpreted as only illustrative and not in a limiting sense.

What is claimed is:

1. A process for spinning a synthetic linear polyamide comprising passing polyamide flake successively through first and second treatment chambers, circulating a inert heated gas through the polyamide flake in the first treatment chamber, passing a dry inert gas with a variable flow rate through the polyamide flake in the second treatment chamber, adding a make-up gas flow with a variable moisture content to the circulating heated gas to control the moisture content of the circulating heated gas, melting the polyamide flake, determining a relative viscosity of the molten polyamide, concurrently varying both the rate of flow of the dry inert gas and the water content of the make-up gas in accordance with the determined relative viscosity of the molten polyamide to maintain a selected relative viscosity of the molten polyamide, and extruding the molten polyamide through a spinning head to form filaments.

2. A process as claimed in claim 1 wherein the determining of the relative viscosity includes measuring a pressure differential across a transfer pipe for the molten polymer, measuring the temperature of the molten polymer, determining a throughput for the molten polymer, and calculating the relative viscosity from the measured pressure differential including compensating the measured pressure differential for any variation of the polymer temperature from a predetermined temperature and compensating the measured pressure differential for any variation of the throughput from a predetermined throughput.

3. A process for spinning a synthetic linear polyamide as claimed in claim 2 further including varying the flow rate of the make-up gas in accordance with the flow rate of the dry inert gas being above or below a predetermined target flow rate to maintain the flow rate of the dry inert gas near the target flow rate, and varying the temperature of the circulating heated gas in accordance with the flow rates of both the dry inert gas and the make-up gas being above or below respective predetermined upper and lower limits to maintain the flow rates of the dry inert gas and the make-up gas within effective ranges.

4. A process as claimed in claim 1 wherein the water content of the make-up gas is varied by passing the make-up gas flow through a water bath, and varying the temperature of the water bath.

5. A process as claimed in claim 2 wherein the water content of the make-up gas is varied by passing the make-up gas flow through a water bath, and varying the temperature of the water bath.

6. A process as claimed in claim 3 wherein the water content of the make-up gas is varied by passing the make-up gas flow through a water bath, and varying the temperature of the water bath.

7. A process as claimed in claim 4 wherein the temperature of the water bath is varied in accordance with a P—I—D algorithm using the determined and selected relative viscosities and a current water temperature as inputs to the algorithm.

8. A process as claimed in claim 5 wherein the temperature of the water bath is varied in accordance with a P—I—D algorithm using the determined and selected relative viscosities and a current water temperature as inputs to the algorithm.

9. A process as claimed in claim 6 wherein the temperature of the water bath is varied in accordance with a P—I—D algorithm using the determined and selected relative viscosities and a current water temperature as inputs to the algorithm.

* * * * *

UNITED STATES PATENT AND TRADEMARK OFFICE

CERTIFICATE OF CORRECTION

PATENT NO. : 4,952,345

DATED : Aug. 28, 1990

INVENTOR(S) : Rao et al.

It is certified that error appears in the above-identified patent and that said Letters Patent is hereby corrected as shown below:

Col. 4, line 35, "332" should be --232--.

Col. 10, line 38, "a" should be --an--;

Signed and Sealed this

Fifteenth Day of June, 1993

*Attest:*

Michael K. Kirk

MICHAEL K. KIRK

*Attesting Officer*

*Acting Commissioner of Patents and Trademarks*